United States Patent [19]

Okamoto et al.

[11] 4,000,711

[45] Jan. 4, 1977

[54] TANK SUPPORTING STRUCTURE FOR SHIPS

[75] Inventors: Tomiyasu Okamoto; Tsunanori Nishimoto; Koji Harada; Seiichiro Murata, all of Osaka, Japan

[73] Assignee: Hitachi Shipbuilding & Engineering Co., Ltd., Osaka, Japan

[22] Filed: Apr. 16, 1975

[21] Appl. No.: 568,628

[30] Foreign Application Priority Data

Apr. 19, 1974 Japan ..... 49-44693
Apr. 19, 1974 Japan ..... 49-44694

[52] U.S. Cl. ..... 114/74 A; 220/9 LG
[51] Int. Cl.[2] ..... B63B 25/08
[58] Field of Search ..... 114/74 A; 248/DIG. 1; 220/9 LG, 15

[56] References Cited

UNITED STATES PATENTS

| | | | |
|---|---|---|---|
| 2,858,136 | 10/1958 | Rind | 114/74 A |
| 3,425,583 | 2/1969 | Bridges | 114/74 A |
| 3,841,253 | 10/1974 | Kircik et al. | 248/DIG. 1 |

FOREIGN PATENTS OR APPLICATIONS

| | | | |
|---|---|---|---|
| 1,007,122 | 10/1965 | United Kingdom | 220/15 |

*Primary Examiner*—George E. A. Halvosa
*Assistant Examiner*—Gregory W. O'Connor
*Attorney, Agent, or Firm*—Farley, Forster and Farley

[57] ABSTRACT

A low temperature liquified gas storage tank is supported in the hull of a ship by a plurality of chocks secured to and spaced peripherally around the tank and by chock engaging members carried by the ship's hull. Pressure resistant heat insulating pads disposed between the chocks and the chock engaging members are arranged to provide sliding surfaces which support the tank horizontally and vertically and permit thermal contracting and expanding movements of the tank relative to the ship's hull and which compensate for thermal expansion and contraction of the chocks and the chock engaging members.

5 Claims, 11 Drawing Figures

TANK SUPPORTING STRUCTURE FOR SHIPS

SUMMARY OF THE INVENTION

The present invention relates to structure for supporting a spherical or cylindrical low temperature liquified gas storage tank with respect to the hull of a ship.

Conventional methods of mounting a spherical or cylindrical tank on a ship include one in which the tank is supported by attaching support members such as skirts or struts to the tank adjacent its intermediate height (at the equator in the case of a spherical tank). With such a conventional method, since the tank and the support members are rigidly fixed together, bending stresses are produced in the support members due to expansion and contraction of the tank, a fact which requires that the support members should have a high strength. The use of large support members, however, results in limiting the expansion and contraction of the tank, thus producing high stresses in the supported region of the tank and in the support members. Repetition of such stresses each time a low temperature liquid is charged or discharged will cause fatigue to the tank and support members.

Therefore, considering the expansion and contraction which takes place in this type of tank due to the large difference in the temperature of the tank when loaded and when not loaded, it is necessary to support the tank in such a manner as to allow expansion and contraction thereof and to avoid excessive stresses otherwise occurrable in the tank and in the support members. On the other hand, it is essential that the tank be prevented from being displaced relative to the ship by pitching and rolling of the latter.

The present invention provides a spherical or cylindrical tank support structure for a ship which meets the two conditions described above.

Thus, the present invention provides a spherical or cylindrical tank support structure including means disposed between the outer periphery of the tank and the tank support deck of a ship for supporting vertical loads on the tank, said structure comprising a plurality of chocks spaced apart from each other circumferentially of the tank, a plurality of pairs of opposed chock holding members disposed on said tank support deck in such a manner that said members in each pair are disposed on opposite sides of one of said chocks circumferentially of the tank, and pressure resistant heat insulating pads disposed between each chock and the associated opposed members holding said chock therebetween, said pressure resistant heat insulating pads abutting against either said chock or said opposed members in such a manner as to allow relative sliding movement radially of the tank.

According to such support structure of the present invention, without providing a special structural member such as a skirt or a column, it is possible to mount a tank on the support deck and to provide a horizontal tank displacement preventive function while allowing the radial movement of the tank caused by the thermal expansion and contraction of the tank. Further, by distributively supporting the tank circumferentially thereof, it is possible to prevent the horizontal movement of the tank without inducing an excessively high stress in the tank.

Other merits and features of the present invention will appear as the description proceeds, when taken in conjunction with the accompanying drawings illustrating preferred embodiments thereof.

DESCRIPTION OF THE PREFERRED EMBODIMENTS

Figure 1:
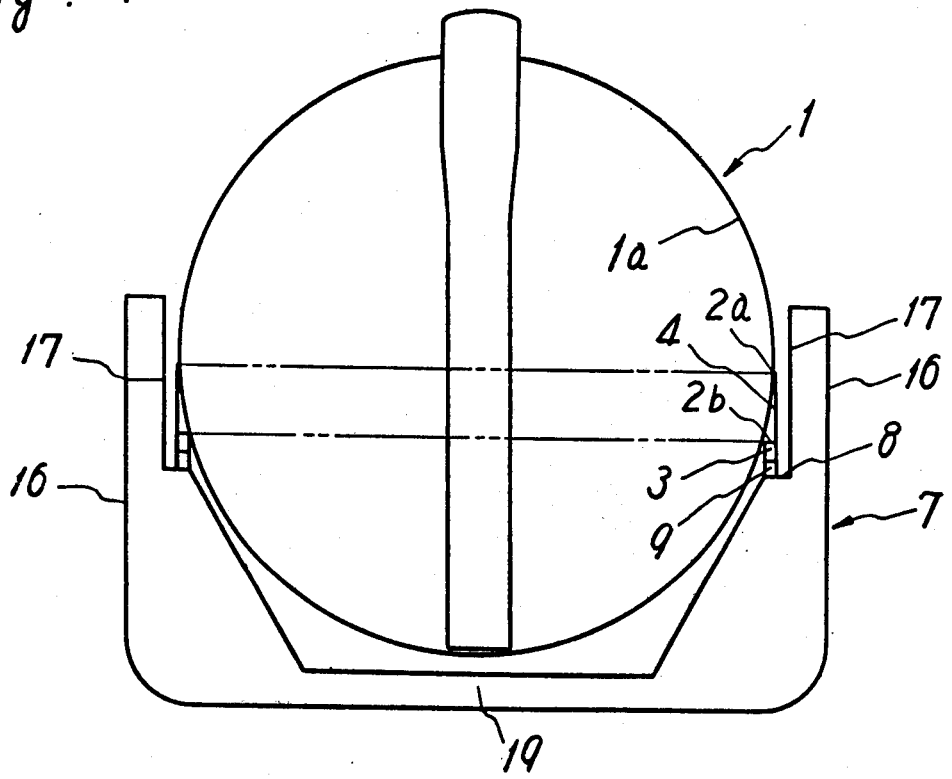
FIG. 1 is a schematic cross-sectional elevation showing the relation between a ship's hull and a spherical tank.
Figure 2:
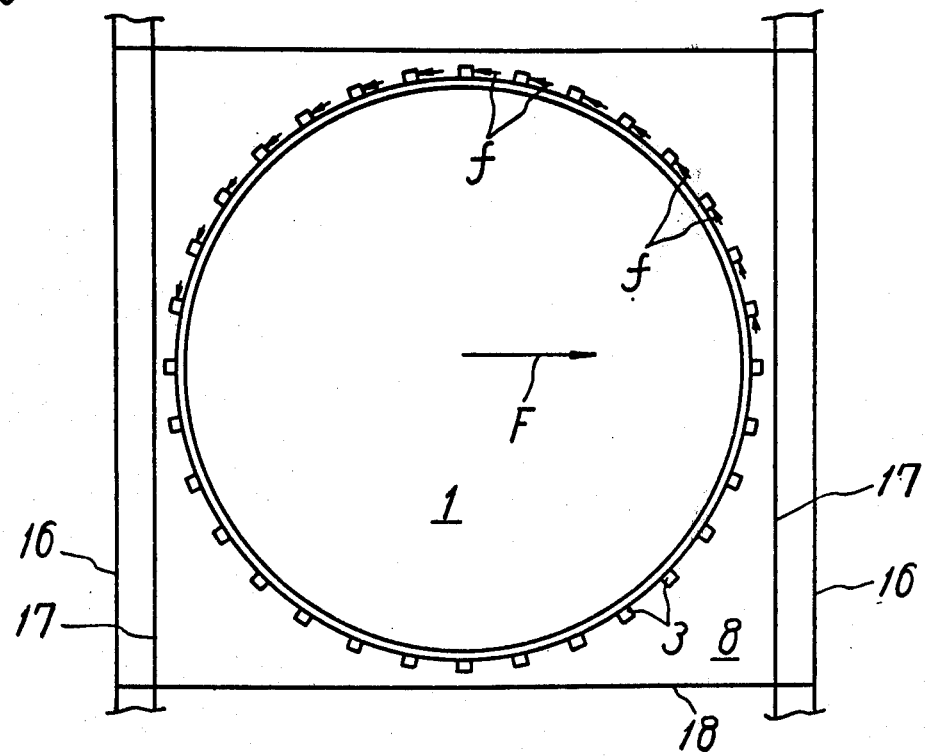
FIG. 2 is a schematic plan view showing said relation.
Figure 3:
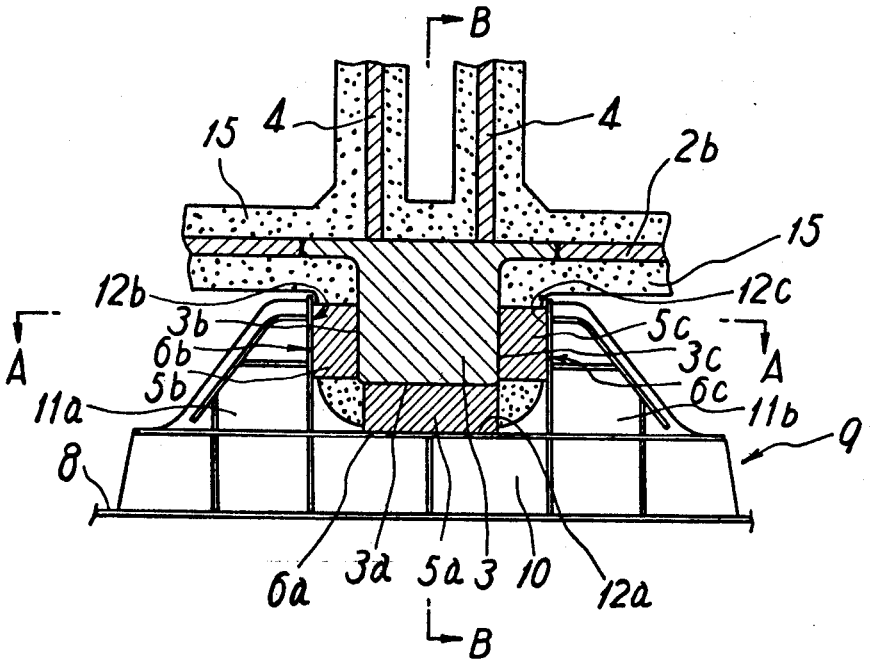
FIG. 3 is a detailed sectional elevation showing one of the supports of the tank.
Figure 4:
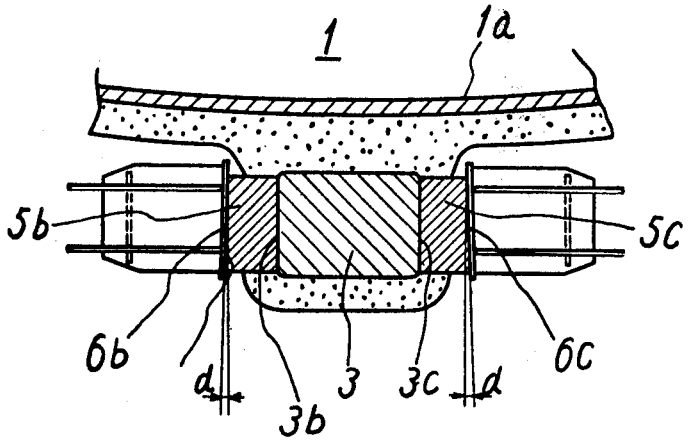
FIG. 4 is a sectional plan view taken along the line A—A of FIG. 3.
Figure 5:
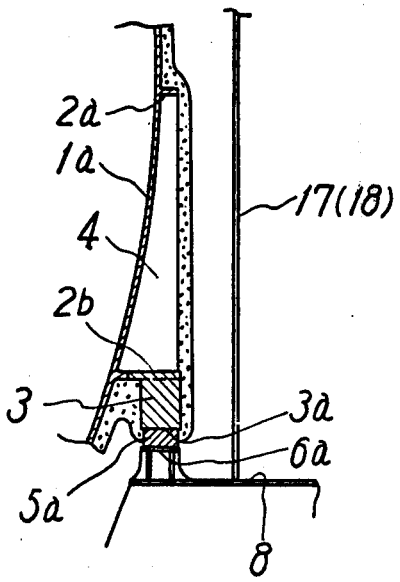
FIG. 5 is a sectional elevation taken along the line B—B of FIG. 3.

In FIGS. 1 through 5, provided on and projecting from a spherical tank 1 at two vertically spaced positions adjacent its equator and therebelow are two horizontal support rings 2*a* and 2*b*. Also, provided on and projecting from the lower surface of the lower support ring 2*b* are a plurality of load support chocks 3 equally spaced around the periphery or circumference of the tank. Stiffeners 4 joined to the tank plate 1*a* are disposed between said upper and lower support rings 2*a* and 2*b* above said load support chocks 3, thereby providing a sufficient support strength. Pressure resistant pads 5*a*, 5*b* and 5*c* of heat insulating material are fixed to the lower surface of each load support chock 3 and to the opposite lateral surfaces 3*b* and 3*c* thereof circumferentially of the tank, and the external surfaces 6*a*, 6*b* and 6*c* of the pads form slides.

A ship's hull 7 in which said tank 1 is mounted is provided with a support deck 8 for supporting said tank 1 below the upper deck. Fixed on said support deck 8 are U-shaped support blocks 9, each associated with one of the load support chocks 3. Each U-shaped support block 9 comprises a horizontal portion disposed below the chock 3 to provide a tank weight support block 10, and a pair of portions projecting from opposite ends of said tank weight block 10 to provide a pair of opposed chock holding members 11*a* and 11*b* facing toward the opposite lateral surfaces 3*b* and 3*c* of the associated load support chock. The slide surfaces 6*a*, 6*b* and 6*c* abut against support surfaces 12*a*, 12*b* and 12*c* consisting of the upper surface of the tank weight support block 10 and the opposed lateral surfaces of the pair of opposed members 11*a* and 11*b* in such a manner as to allow relative sliding movement between each chock 3 and support block 9 radially of the tank.

Since the load support chocks 3 and the pressure resistant heat insulating pads 5*b* and 5*c* will thermally contract circumferentially of the tank upon thermal contraction of the tank 1, there will be the danger of a clearance being created between the slide surfaces 6*b*, 6*c* and the support surfaces 12*b*, 12*c*. In order to prevent this, the pairs of relatively slidable abutment surfaces 6*b*, 12*b* and 6*c*, 12*c* between said pressure resistant heat insulating pads 5*b*, 5*c* and the opposed members 11*a* and 11*b* are inclined at an angle of inclination $\alpha$ (FIG. 4) in such a manner that they gradually approach each other, or converge, as they extend toward the center of the tank 1.

Figure 6:
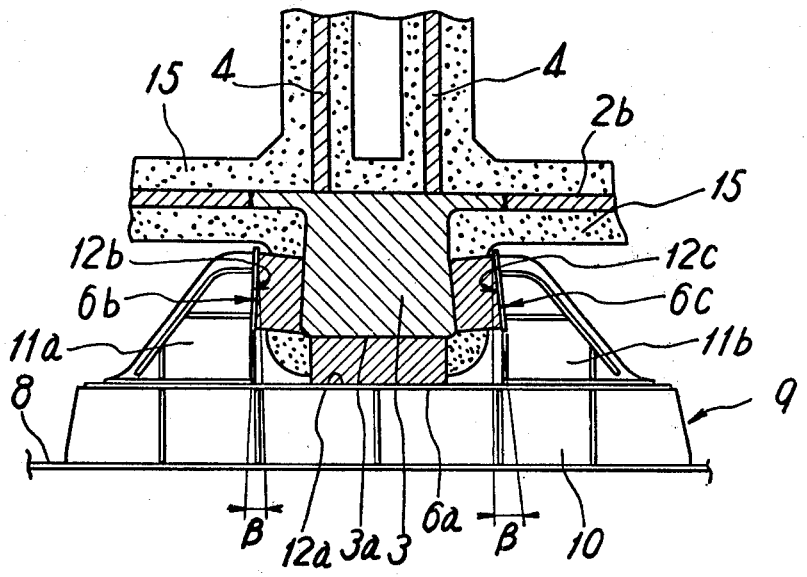
FIGS. 6 and 7 are sectional elevations similar to FIG. 3 but showing other embodiments.

In order to include the function of preventing upward floating movement of the tank in the U-shaped support block 9 (possessing both the function of supporting vertical loads on the tank and the function of preventing horizontal movement of the tank), said pairs of relatively slidable surfaces 6*b*, 12*b* and 6*c*, 12*c* may be inclined at an angle of inclination $\beta$ in such a manner that they gradually approach each other, or converge, as they extend upwardly, as shown in FIG. 6. In this case, at least one of the opposed members 11*a* and 11*b* will be fixed on the tank weight support block 10 after mounting of the tank 1.

Other references included in the drawings are: 15, a heat insulating material applied to the outer surface of the tank; 16, the outer plate of the ship's hull; 17, a longitudinal partition wall; 18, a transverse partition wall; and, 19 a double bottom.

The operation will now be described. The weight of the tank 1 is distributively supported on the tank weight support blocks 10 by the chocks 3 through the intermediary of the pressure resistant heat insulating pads 5*a*. There is no possibility of the tank being restrained, since the support surfaces 12*a* and the slide surfaces 6*a* are slidable radially of the tank when the tank 1 expands or contracts due to a change in the temperature of the tank. There may be a force acting on the tank tending to move it horizontally. However, since the opposite lateral surfaces 3*b* and 3*c* of each load support chock 3 are held between the opposed pair of associated members 11*a* and 11*b* and there are many circumferentially disposed chocks 3, even if a horizontal force F (FIG. 2) acts on the tank, the tank can be distributively supported by the reactions *f* acting on the many chocks 3 so that its horizontal movement can be prevented. Moreover, because of the presence of the relatively slidable opposed surfaces 6*b*, 12*b* and 6*c*, 12*c*, the tank will not be restrained from its radial expansion and contraction. Further, in the case where such relatively slidable opposed surfaces 6*b*, 12*b* and 6*c*, 12*c* have a downwardly diverging angle of inclination $\beta$, as shown in FIG. 6, upward movement of the load support chocks 3 can be prevented and hence a tank floating-up preventing function is provided, in which case also the tank 1 is not restrained in its radial expansion and contraction.

Figure 7:
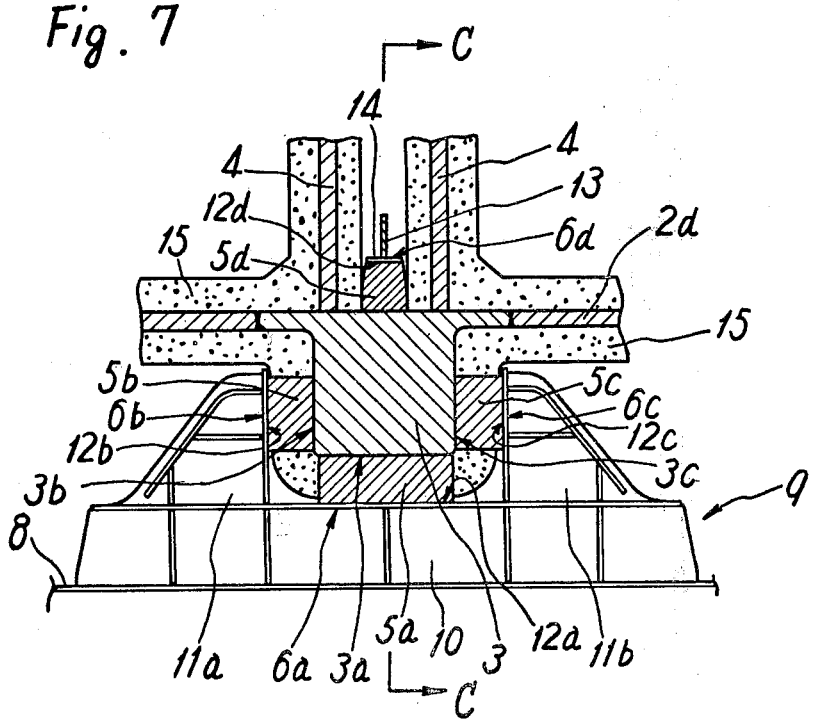
Figure 8:
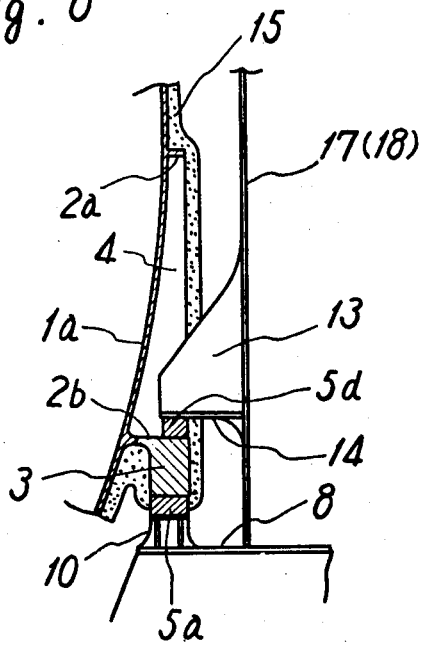
FIG. 8 is a sectional elevation taken along the line C—C of FIG. 7.
Figure 9:
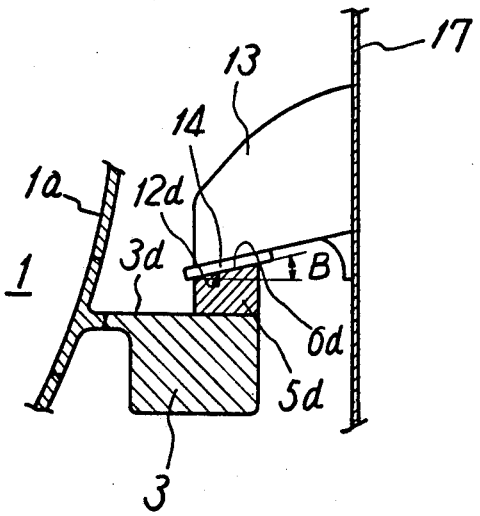
FIG. 9 is a sectional elevation of a further embodiment, showing the principal portions thereof.

FIGS. 7 and 8 illustrate another means for preventing the tank from floating up. In this example, a pressure resistant heat insulating pad 5*d* is fixed on the upper surface 3*d* of each load support chock 3, while the lower surface 12*d* of a retainer member 14 fixed to the lower end of a stiffener 13, projecting from the partition walls 17 and 18 of the hull 7, abuts against a slide surface 6*d* on the upper end of the pad, thereby preventing the load support chock 3 and hence the tank 1 from floating up. Of course, the slide surface 6*d* and the support surface 12*d* are slidable radially of the tank 1. In this case, since the load support chock 3 and the pressure resistant heat insulating pad 5*d* will thermally contract in the direction of height upon thermal contraction of the tank 1, there will be the danger of a clearance being created between the slide surface 6*d* and the support surface 12*d*. In order to prevent this, the relatively slidable opposed surfaces 6*d* and 12*d* between the retainer member 14 and the pressure resistant heat insulating pad 5*d* may be provided with an inwardly descending angle of inclination B, as shown in FIG. 9.

In the embodiments described above, all of the pressure resistant heat insulating pads 5*a* – 5*d* have been fixed to the chock 3. However, they may be fixed to the opposed members 11*a* and 11*b*, to the support surface of the tank weight support block 10 and to the holder member 14 so that they relatively slidably abut against the surfaces 3*a* – 3*d* of the chock 3. Further, the horizontal support rings 2*a* and 2*b* are intended to increase the circumferential strength of the tank 1, and although it is desirable to attach the chocks 3 to the outer periphery of the tank thus reinforced by said rings 2*a* and 2*b*, the rings 2*a* and 2*b* are not essential for the construction of the present invention. Further, in the case of attaching the chocks 3 to the ring 2*b*, the chocks may be fixed to the lower side of the ring 2*b* rather than arranging them so that they constitute portions of the ring 2*b* in the illustrated manner.

Figure 10:
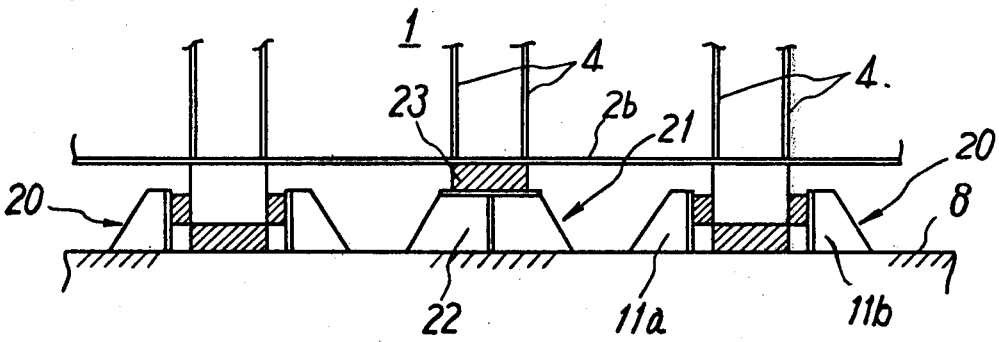
FIGS. 10 and 11 are schematic elevational views of still other embodiments.

A support device shown at 20 in FIG. 10 is such that the two opposed members 11*a* and 11*b* are fixed on the support deck 8 without using the U-shaped support block 9, with the pressure resistant heat insulating pad 5*a* interposed between the support deck 8 and the chock 3. A support device shown at 21 in FIG. 10 is a vertical load support means comprising a pressure resistant heat insulating pad 23 interposed between the ring 2*b* and a tank weight support block 22 fixed on the support deck 8. The support devices shown in FIGS. 3 – 5, in FIG. 6 and in FIGS. 7 and 8 and the support device 20 shown in FIG. 10 also serve as vertical load support means for the tank. Therefore, such support devices alone may be used to support the tank 1, but as shown in FIG. 10 a suitable number of support devices 21 designed for exclusive use for support of vertical loads on the tank may also be incorporated to support the tank. Further, a number of support devices having the additional function of preventing the upward floating of the tank, such as shown in FIGS. 6 through 9, may be combined with support devices which do not have this function, such as the devices shown in FIGS. 3 through 5, so as to support a single tank 1.

Figure 11:
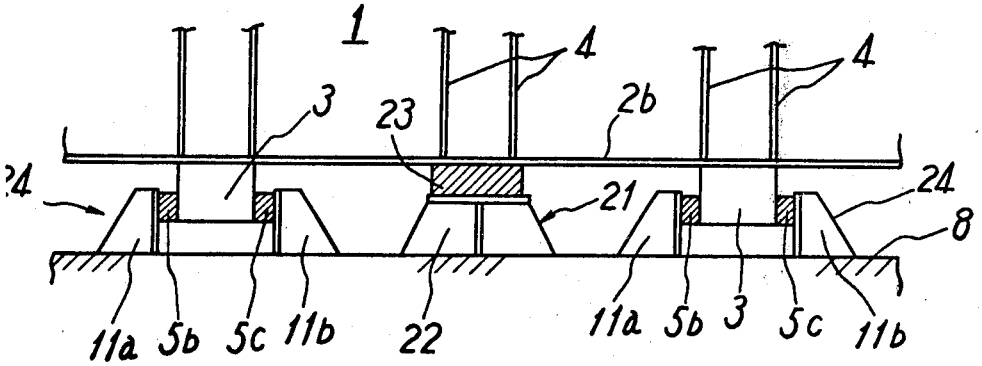

A support device shown at 24 in FIG. 11 has no pressure resistant heat insulating pad 5*a* and no function of supporting vertical loads on the tank. In this case, the support device 21 for exclusive use for support of vertical loads on the tank may, of course, be additionally used to support the tank 1. Further, the present invention is not limited in application to a spherical tank, but it may be applied to a vertically mountable cylindrical tank or to a horizontally mountable cylindrical tank, without any modification.

We claim:

1. Structure for supporting a tank on a support deck of a ship comprising:

a plurality of chocks secured to the tank and spaced apart from each other around the outer periphery of the tank adjacent said support deck;

a plurality of pairs of opposed chock holding members mounted on said tank support deck, each pair of said chock holding members being disposed peripherally of the tank on opposite sides of one of said chocks;

pressure resistant heat insulating pads positioned between each chock and the pair of chock holding members associated therewith, said pads, said chock and said pair of chock holding members being arranged so as to provide opposed pairs of relatively slidable vertical abutment surfaces which permit relative movement radially of the tank between each chock and associated pair of chock holding members, said opposed pairs of relatively slidable vertical abutment surfaces converging as they extend upwardly to prevent upward movement of the tank relative to the support deck; and means disposed between the outer periphery of the tank and said tank support deck for supporting vertical loads on the tank by abutting horizontal surfaces which permit relative sliding movement between the tank and the tank support deck.

2. Tank supporting structure as set forth in claim 1 wherein said means for supporting vertical loads on the tank comprises a tank support surface between said pairs of opposed chock holding members, and a pressure resistant heat insulating pad disposed between the lower side of each chock and said tank support surface in such a manner as to allow relative movement radially of the tank between each chock and said tank support surface.

3. Tank supporting structure as set forth in claim 2 comprising a plurality of U-shaped support blocks secured to said support deck, each of said support blocks having a pair of projecting members serving as said opposed chock holding members and having said support surface disposed between said pair of projecting members.

4. Tank supporting structure as set forth in claim 1 wherein said opposed pairs of relatively slidable vertical abutment surfaces gradually converge as they extend toward the center of the tank.

5. Structure for supporting a tank on a support deck of a ship comprising:

a plurality of chocks secured to the tank and spaced apart from each other around the outer periphery of the tank adjacent said support deck;

a plurality of pairs of opposed chock holding members mounted on said tank support deck, each pair of said chock holding members being disposed peripherally of the tank on opposite sides of one of said chocks;

pressure resistant heat insulating pads positioned between each chock and the pair of chock holding members associated therewith, said pads, said chock and said pair of chock holding members being arranged so as to provide opposed pairs of relatively slidable vertical abutment surfaces which permit relative movement radially of the tank between each chock and associated pair of chock holding members;

means for preventing upward movement of the tank including a retainer member carried by the ship, and a pressure resistant heat insulating pad interposed between said retainer member and the upper surface of one of said chocks so as to provide a pair of relatively slidable retaining surfaces which permit relative movement radially of the tank between said one chock and said retainer member, said pair of relatively slidable retaining surfaces being inclined in such a manner that their level gradually decreases as they extend toward the center of the tank; and means disposed between the outer periphery of the tank and said tank support deck for supporting vertical loads on the tank by abutting horizontal surfaces which permit relative sliding movement between the tank and the tank support deck.

* * * * *